US006357905B1

(12) United States Patent
Birchard

(10) Patent No.: US 6,357,905 B1
(45) Date of Patent: Mar. 19, 2002

(54) APPARATUS FOR THE BLENDING OF MATERIALS

(76) Inventor: Ronald W. T. Birchard, 1239 Parsons La., Oakville, Ontario (CA), L6M 1K3

( * ) Notice: Subject to any disclaimer, the term of this patent is extended or adjusted under 35 U.S.C. 154(b) by 0 days.

(21) Appl. No.: 09/663,792

(22) Filed: Sep. 18, 2000

(30) Foreign Application Priority Data

Oct. 5, 1999 (CA) ..... 2285154

(51) Int. Cl.[7] ..... B01F 7/16; B28C 5/08

(52) U.S. Cl. ..... 366/65; 366/178.1; 366/181.4; 366/181.1; 366/315

(58) Field of Search ..... 366/178.1, 181.4, 366/181.1, 156.1, 156.2, 137.1, 113, 114, 65, 315, 316, 317, 285, 286, 332; 118/303

(56) References Cited

U.S. PATENT DOCUMENTS 860,031 A * 7/1907 Jones
872,729 A * 12/1907 Hiller
2,658,049 A * 11/1953 Adams
2,955,956 A * 10/1960 Baugh et al.
3,013,525 A * 12/1961 Fuller et al.
3,288,052 A * 11/1966 Hough
3,346,240 A * 10/1967 Lavelle et al. ..... 366/156.2
3,717,086 A * 2/1973 Hough
3,871,625 A * 3/1975 Iwako
3,934,859 A * 1/1976 Deve
3,967,815 A * 7/1976 Backus et al.
3,986,706 A * 10/1976 Giombini ..... 366/315
4,112,517 A * 9/1978 Giombini ..... 366/315
4,190,369 A * 2/1980 Rikker ..... 366/65
4,257,710 A * 3/1981 Delcoigne et al.
4,341,349 A * 7/1982 Hartmut
4,407,217 A * 10/1983 Jackson
4,408,889 A * 10/1983 Peschl ..... 366/114
4,453,832 A * 6/1984 Schumacher et al. ..... 366/315
4,522,500 A * 6/1985 Hyer ..... 366/114
4,698,378 A * 10/1987 Wehrli et al.
4,834,542 A * 5/1989 Sherwood
5,046,855 A 9/1991 Allen et al.
5,073,032 A * 12/1991 Berlon et al.
5,358,328 A 10/1994 Inoue et al. ..... 366/65
5,419,633 A 5/1995 Lorenzetti et al. ..... 366/40
5,605,397 A 2/1997 Oberg et al. ..... 366/18
5,695,648 A 12/1997 Fassbender et al.
5,730,523 A 3/1998 Flood ..... 366/18
5,776,515 A 7/1998 Possanza et al.
5,813,754 A 9/1998 Williams ..... 366/114
5,865,534 A * 2/1999 Hay
5,908,240 A * 6/1999 Hood ..... 366/114

* cited by examiner

*Primary Examiner*—Tony G. Soohoo

(57) ABSTRACT

An apparatus and method for blending dry comminuted materials which is particularly effective for comminuted materials having disparate physical properties such as density and particle size. The dry blending apparatus includes a substantially upright wall defining a blending enclosure, a feed mechanism for feeding dry comminuted materials into the blending enclosure, and a rotational distribution mechanism for distributing the dry comminuted materials onto the wall by causing the dry comminuted materials to fly outwardly by centrifugal force.

17 Claims, 6 Drawing Sheets

APPARATUS FOR THE BLENDING OF MATERIALS

FIELD OF THE INVENTION

The present invention relates to an apparatus and method for blending dry comminuted, granular or powdered materials.

BACKGROUND OF THE INVENTION

Cement is an extensively used product in all industrialized areas of the world. It has now becoming common in certain third world countries. Any advances in technology to make cement more accessible to poorer countries is desirable, along with methods to reduce the amount greenhouse gases released during production.

The most cost effective way to make cement affordable to all countries is to use cheaper, more readily available components in the cement mix and/or finding cheaper way to combine the ingredients of cement. At the same time however care must be taken to ensure that the cement maintains it's physical properties.

The current method of producing cement involves costly rotary kiln firing of a mixture of ground limestone, clay and small amounts of fluxing agents, alumina and iron. The product of this combustion is called Clinker. Clinker is then finely ground and homogeneously mixed with gypsum to produce traditional cement. This process is not only costly due to the large amount of fuel consumed by the firing process, but also environmentally unsound in that a large amount of carbon dioxide ($CO_2$) released into the atmosphere.

Carbon dioxide ($CO_2$) is a greenhouse gas that rises into the upper atmosphere and traps solar heat, therefore contributing to global warming. Combustible reactions using fuel release large amounts of carbon dioxide($CO_2$) due to incomplete combustion. As well the chemical reaction that produces Clinker also produces carbon dioxide ($CO_2$) due to calcination of the limestone. Therefore cement production is a major contributor of greenhouse gases into the atmosphere, having a total evolution of one ton of carbon dioxide gas ($CO_2$) per one ton of Clinker. In view of the importance of reducing greenhouse gases, new methods of production are required or at least more efficient processes.

One method of creating a more efficient process is to use ingredients that will increase the volume of cement produced, thereby increasing the percent yield of the process. Pozzolanic materials are compounds that have cementitious properties and when mixed with lime, water and gravel produce concrete that has the same or even superior strength than traditional concrete. Addition of pozzolanic material to cement increases the amount of product. In this case fly ash is the pozzolanic material examined.

Fly ash is a by-product of combusted coal. Coal is commonly used to fire steam boilers, steam is then used to generate electrical power. Since coal is not pure carbon, non-combustible material is generated and this is called fly ash. This fly ash consists of fine, minute particles of glassy spheres. These particles are carried out of the boilers by flue gases and collected in gas filters. Chemically, fly ash is predominantly oxides of silicon, aluminum and iron with small percentages of oxides of calcium, magnesium, titanium and the alkalis. Physically, fly ash is a fine powder comprised of minute glassy particles, mainly spherical, with an average particle diameter of 10–15 microns. This is a waste product that is difficult to handle and due to anti-pollution regulations worldwide, a costly matter to dispose of.

Due to the finely divided size and the cementitious nature of this fly ash, blends using the correct percentages of fly ash with cement produce a superior product. This blended product is known as blended cement or pozzolanic blend.

The use of fly ash in concrete provides significant advantages to both the plastic and hardened properties of concrete. In the plastic state, workability is significantly improved and a lower water-cement ratio can be used which improves the concrete strength. In the hardened state long term strength and sulfate and alkali-silica reaction resistance are improved and chloride penetration is reduced.

Fly ash is commonly blended with cement to increase the volume without jeopardizing the integrity of the concrete. Since it is a waste product of another process it is readily available and cheap, compared to the cost of producing Clinker. Using fly ash with cement provides a lucrative and industrial way of utilizing it and keeping it out of the landfills. The fly ash replaces clinker in cement with a 1:1 ratio. Therefore reducing the release of carbon dioxide ($CO_2$) from combustion and calcination by a 1:1 ratio as well. In other words the use of one ton of fly ash replaces one ton of clinker and therefore one ton of carbon dioxide ($CO_2$) released into the atmosphere. When compared to the 100 million tons of cement used in the US in 1997 and the 100 million tons of carbon dioxide ($CO_2$) produced, it is obvious that a 1:1 ratio reduction would make a significant difference. 20 to 25% of fly ash is commonly used in the US with percentages increasing or decreasing depending on the end product. A 20% substitution with fly ash would of reduced the carbon dioxide ($CO_2$) evolution by 20 million tons and kept 20 million tons of fly ash out of the landfill, as well as kept dumping costs down for the respective power companies.

To maintain unified physical properties throughout mixed concrete, the cement must be a homogeneous mixture of all of it's components. Mixing of fly ash with the limestone of cement has an inherent difficulty due to different physical properties such as density and flowability. The success of the fly ash blended cement requires reliable proportioning and thorough, homogenous blending.

Conventional methods of blending the fly ash with the cement have several difficulties. The percentage of fly ash that can be mixed easily is kept to very low levels. These methods also require a large amount of electrical energy and consequently involve the release of carbon dioxide ($CO_2$) gas produced by electrical power generation. In some cases, because of the nature of the materials, using conventional commercially available dry mechanical mixers can lead to separation instead of the expected blending.

For example, in one method of blending fly ash with cement, the fly ash is added during the grinding and blending of the clinker and gypsum. In this case, all of the materials are placed into a large ball mill. The ball mill is a large metal cylinder that contains a number of metal balls. As the cylinder is rolled, the balls cascade to grind and blend the materials. The ball mill is large, expensive and requires a lot of energy to operate. If the fly ash is added at this stage, the amount of time that the ball mill must be operated must be increased. Furthermore, the end product will only have a fixed percentage of fly ash that cannot be adjusted based on the particular needs of an individual project. Also, because of the different physical properties of fly ash and clinker, one of the components may L)e overground resulting in wasted energy.

In other conventional methods of blending, the fly ash and cement are blended in a separate blender. Conventional blenders are either mechanical, using mechanical ribbons or screws to blend the materials, or pneumatic, in which compressed air is passed through the materials to blend the materials. Both of these methods again use significant quantities of energy due to the weight of the materials and have problems with achieving an appropriate degree of homogeneity.

An energy efficient, inexpensive method of homogeneously blending fly ash with cement would result in a large reduction in the emissions of carbon dioxide ($CO_2$) gas, a reduction in the amount of fly ash put into landfill and the resulting risk of ground water pollution, and would provide for cheaper, more easily accessible concrete, particularly in developing nations where the capital cost of a ball mill or similar blending device is prohibitive. Also, the proportions of the flyash/cement mix could be varied easily to suit the specification of a particular end-user.

Other industrial blending operations in which dry materials must be blended use similar methods and devices to those described above, these industrial process would also benefit from an energy-efficient, inexpensive method of homogeneously blending dry comminuted, granular or powdered materials.

BRIEF SUMMARY OF THE INVENTION

In order to overcome the problems described above, according to an embodiment of the invention, there is provided an improved dry blending apparatus for blending particulate dry comminuted materials including a substantially upright wall defining a blending enclosure, a feed means for feeding the dry comminuted materials into said blending enclosure, and a rotational distribution mechanism for distributing said dry comminuted materials onto said upright wall by causing said dry comminuted materials to fly outwardly by centrifugal force, and includes mechanism for raising and lowering the distribution plate relative to the upright wall.

The use of an energy efficient centrifugal force to distribute the comminuted materials results in an even distribution of comminuted materials on the upright wall. The dry materials collect on the upright wall in a very thin layer over a large collection area. The comminuted materials are partly mixed when they reach the upright wall and then mix further as they slough down off the upright wall due to gravity. Resulting in a very homogeneous mixture of the dry comminuted materials.

The blending enclosure is preferably substantially cylindrical but may also have non-circular cross-section.

In this embodiment of the invention, the dry blending apparatus may also include a tapering chute connected at a base of the substantially upright walls. The tapering chute is preferably substantially conical but may also have a non-circular cross-section. The homogeneous mixture sloughs off the upright collecting walls into the tapering chute.

The rotational distribution mechanism may include a distribution motor, a distribution shaft, driven by the distribution motor, placed along a central axis of the blending enclosure, and a distribution plate connected to the shaft. With this arrangement, the distribution plate and the feed mechanism are positioned such that the dry comminuted materials are fed from the feed mechanism onto the distribution plate so that, as the comminuted materials come into contact with the distribution plate, the comminuted materials are driven by the spinning distribution plate by centrifugal force outwardly towards the upright wall.

Preferably, the distribution plate is provided with a plurality of acceleration ridges on a top surface of the distribution plate.

The rotational distribution mechanism may further include a mechanism for raising and lowering the distribution plate relative to the upright wall.

The feed means may include a plurality of feed mechanisms with each feed mechanism including a hopper, an auger tube connected to the hopper, an auger shaft disposed within said auger tube an auger screw provided at one end of said auger shaft, a plurality of paddles provided at a second end of said auger shaft, an auger drive motor for driving said auger shaft, and a delivery chute connected to said auger tube adjacent to said plurality of paddles. This arrangement allows a controlled feed of the dry comminuted materials into the blending enclosure.

In another embodiment, the dry blending apparatus may include a vibration mechanism for vibrating the blending container or a part thereof.

In yet another embodiment, the dry blending apparatus may include a rotation mechanism for rotating the substantially upright wall. This rotation may be in the same direction as, or in a direction opposite to, the direction of rotation of the rotational distribution mechanism.

According to another embodiment of the invention, a dry blending apparatus for blending dry comminuted materials includes a vertical cylindrical wall defining a blending enclosure, a feed mechanism for feeding dry comminuted materials into said blending enclosure, a distribution shaft positioned on a centre-line of said blending enclosure, a distribution motor for rotating said distribution shaft, a distribution plate attached to said distribution shaft and positioned such that said dry comminuted materials from said feed mechanism contact said distribution plate whereby said dry comminuted materials are distributed against said wall by centrifugal force, and a tapering chute in communication with said blending enclosure for collecting blended dry comminuted materials as the blended dry comminuted materials slough off the cylindrical wall due to the force of gravity.

According to yet another embodiment of the invention, there is provided a method of blending dry comminuted materials comprising the steps of distributing the dry comminuted materials against a substantially upright wall by centrifugal force and allowing blended dry comminuted materials to slough off the wall due to gravity. This method may also include a step of feeding the dry comminuted materials into a blending enclosure defined by the substantially upright wall prior to the distributing step.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

As described above, the present invention relates to an apparatus and method for blending dry comminuted, granular or powder materials. The materials to be blended may be any of various comminuted materials. The present invention is particularly useful when the comminuted materials to be blended have disparate physical properties such as density and flowability. In this specification, the example of blending fly ash and cement is used by way of illustration, and without limitation.

Embodiments of the dry blender are described with reference to FIGS. 1–14, in order to illustrate the invention.

Figure 1:
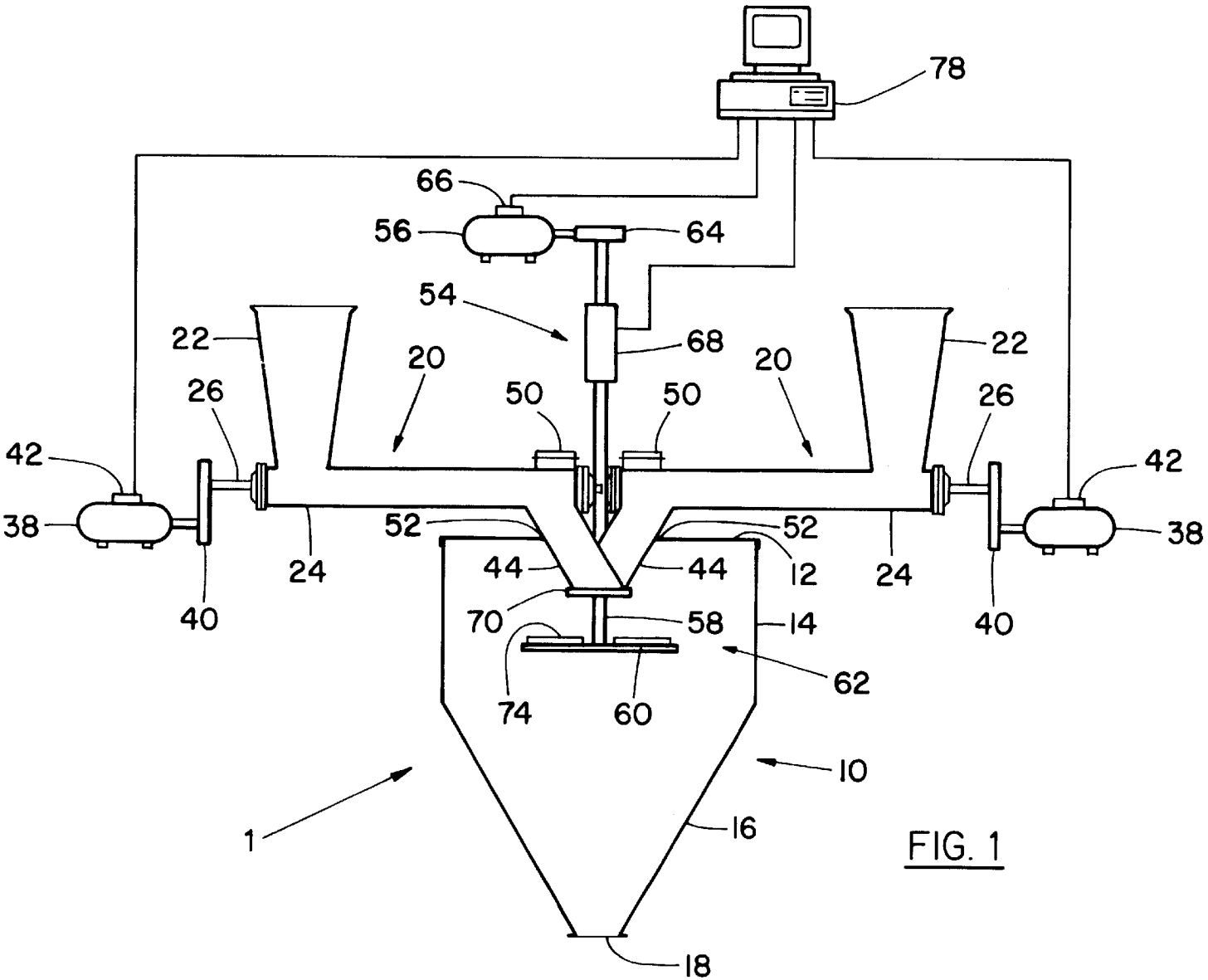
FIG. 1 is a schematic view of an embodiment of the dry blending apparatus illustrating the invention.

Referring to FIG. 1, a first embodiment of the dry blender 1 includes a blending container 10. As shown in more detail in FIG. 2, the blending container 10 includes a cover 12 covering a side slough wall 14 which, in this case, is cylindrical and substantially upright. The side slough wall 14 connects with a conical slide wall 16. The slide wall 16 converges to define an output opening 18.

As shown in FIG. 1, one or more feed units 20 are arranged to feed dry comminuted materials into the blending container 10. The feed units 20 may be of different sizes and configurations to suit each comminuted material to be mixed. In the current embodiment, two similar-sized feed units 20 are used as an example. The feed units 20 include the same components and for simplicity similar components are assigned the same reference numbers.

Figure 4:
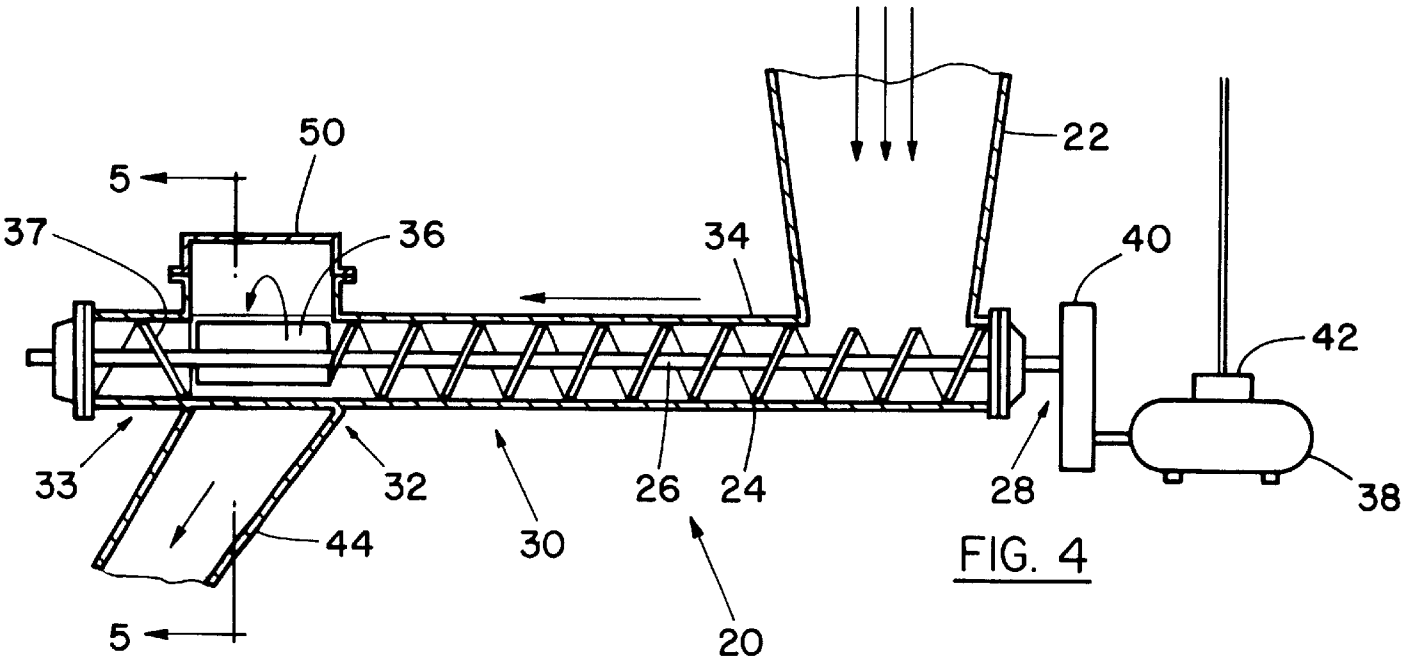
FIG. 4 is a schematic view of a feed unit of the dry blending apparatus of FIG. 1.

As shown in more detail in FIG. 4, each feed unit 20 includes a hopper 22 that is connected to a generally cylindrical auger tube 24.

The auger tube 24 partially houses an auger shaft 26 having, in order, a drive section 28, an auger screw section 30, a paddle section 32, and a reverse screw section 33.

The auger screw section 30 is provided with an auger screw 34 running along the length thereof. The diameter of the auger screw 34 is slightly smaller than the diameter of the auger tube 24.

Figure 5:
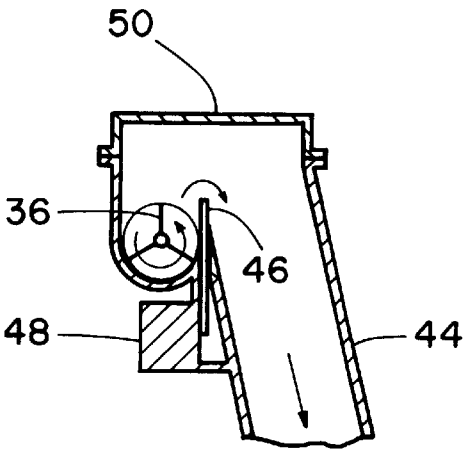
FIG. 5 is a schematic cross section view of the feed unit of FIG. 4.

The paddle section 32 of the auger shaft 26 is provided with a plurality of paddles; 36 placed around the circumference of the auger shaft 26. As shown in FIG. 5, the paddles 36 extend perpendicularly from the auger shaft 26 and have a length such that the paddles 36 almost come into contact with the auger tube 24.

The reverse screw section 33 of the auger shaft 26 is provided with a reverse auger screw 37, similar to the auger screw 34, but having an opposite pitch to reverse the flow of material in the auger tube 24 and return the material to the paddle section 32.

The drive section 28 of the auger shaft 26 extends lengthwise outside of the auger tube 24 and is connected with an auger drive motor 38 by an auger gear assembly 40. The speed of the auger drive motor 38 is controlled by an auger drive speed controller 42.

As shown in FIG. 5, a delivery chute 44 is attached to the auger tube 24 opposite the paddle section 32 of the auger shaft 26. The delivery chute 44 is separated from the auger tube 24 by an adjustable weir plate 46. The weir plate 46 is attached slideably between the auger tube 24 and the delivery chute 44 such that the weir plate 46 is movable upwards and downwards. The height of the weir plate 46 is set or adjusted by a weir height adjustment mechanism 48 provided adjacent to the weir plate 46. The auger tube 24 is provided with a raised hatchway 50 above the connection with the delivery chute 44 to allow viewing of the material flow during set up and operation.

Referring again to FIG. 1, the delivery chutes 44 enter the top of the blending container 10 through input openings 52 in the cover 12. The delivery chutes 44 are positioned to deliver the comminuted materials as close to the center of the blending container 10 as possible.

Figure 2:
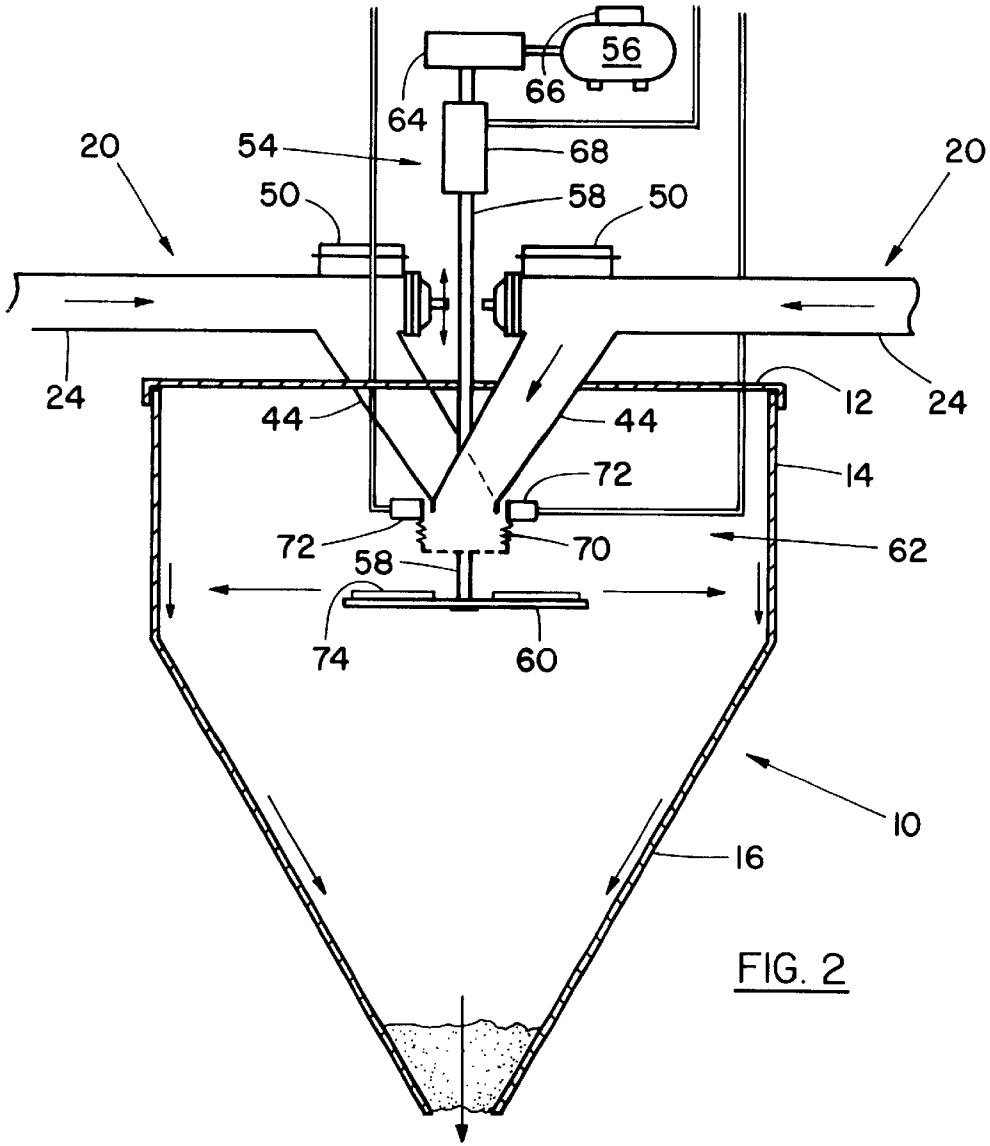
FIG. 2 is a schematic view of a blending container of the dry blending apparatus of FIG. 1.

As shown in FIGS. 1 and 2, a distribution unit 54 includes a distribution motor 56, a distribution shaft 58, and a distribution plate 60. The distribution shaft 58 is centrally and rotatably mounted with respect to the blending container 10. The distribution plate 60 is attached at an end of the distribution shaft 58 such that the distribution plate 60 is centrally positioned in an upper portion 62 of the blending container 10. The other end of the distribution shaft 58 is connected to the distribution motor 56 by a distribution gear assembly 64. The distribution motor 56 is controlled by a distribution speed controller 66. The distribution motor 56 drives the distribution shaft 58 such that the distribution plate 60 rotates within the blending container 10.

The distribution shaft 58 and distribution plate 60 in this embodiment, optionally can be raised or lowered by a distribution adjustment mechanism 68 although this may not always be desired. Further, in order to maintain a constant distance between the delivery chutes 44 and the distribution plate 60, the delivery chutes 44 are provided with adjustable skirts 70 that are raised or lowered by skirt adjustment mechanisms 72.

Figure 3:
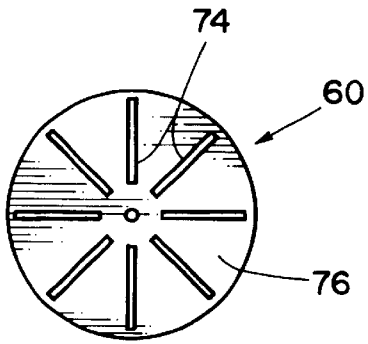
FIG. 3 is a top view of a distribution plate of the dry blending apparatus of FIG. 1.

As shown in FIG. 3, the distribution plate 60 is provided with a plurality of acceleration ridges 74 placed around at least an upper surface 76 of the distribution plate 60.

In operation, dry comminuted material or materials are fed into the hopper 22 by some conventional means (not shown) and are then gravity fed to the auger tube 24. As the auger drive motor 38 and auger gear assembly 40 drive the auger shaft 26, the auger screw 34 turns and pushes the material along the auger tube 24 until the material reaches the paddle section 32 of the auger shaft 26. In the paddle section 32, the paddles 36 lift the material over the weir plate 46 and the material slides down the delivery chute 44.

As the dry comminuted materials enter the blending container 10 from the delivery chutes 44, the materials contact the distribution plate 60 and acceleration ridges 74. The spinning rotation of the distribution plate 60 drives the materials by centrifugal force outwardly toward the side slough wall 14. The materials strike the side slough wall 14 and form a slight build-up of partially blended materials on the side slough wall 14. Depending on the type of materials being blended, this build-up may accumulate in approximately 1/16" thick layers. The blended materials then slough and slide downward along the side slough wall 14 by gravity and eventually along the slide wall 16 to further carry out the blending process. The fully blended materials are then removed from the output opening 18.

The auger drive speed controllers 42, the distribution speed controller 66, the weir height adjustment mechanism 48, the skirt adjustment mechanisms 72 and the distribution adjustment mechanism 68 may be set and controlled manually, or, as shown in FIG. 1, may be connected to and controlled by a central processing device 78 (CPU) such as a computer.

The CPU 78 can be used to program or adjust the feed rate and distribution of the dry comminuted materials in the blending container 10.

The feed rate can be adjusted by varying the speed of the auger drive motors 38 through the auger drive speed controllers 42. By adjusting the feed rate, the comminuted materials can be blended in various percentage mixes. Furthermore, by adjusting the feed rate in conjunction with the height of the weir plate 46, it is possible to provide smooth, metered feeding of the dry comminuted materials.

The CPU 78 can control the distribution of the dry comminuted materials within the blending container by causing the distribution adjustment mechanism 68 to move the distribution plate 60 upwardly and downwardly within the upper portion 62 of the blending container 10. As the distribution plate 60 traverses vertically, the materials will be distributed evenly up and down the side slough wall 14. The skirt adjustment mechanisms 72 can be driven to coincide with the driving of the distribution adjustment mechanism 68 to maintain a predetermined spacing between the adjustable skirts 70 and the distribution plate 60. Alternatively, the skirt adjustment mechanisms 72 can be operated independently of the distribution adjustment mechanism 68 to adjust the spacing between the adjustable skirts 70 and the distribution plate 60 for the blending of particular materials. Adjusting the distribution of the materials allows the use of the dry blender 1 for many kinds of materials and allows the production of a more homogeneous blend.

The CPU 78 can also be used to control the distribution speed controller 66 to adjust the rotational speed of the distribution plate 60. The rotational speed of the distribution plate 60 is varied depending on the kind of materials being fed or depending on the feed rate of the materials.

The present invention also encompasses a method of blending dry comminuted materials as outlined above. For example, a method of blending dry comminuted materials including the steps of rapidly distributing dry comminuted materials to be blended on an upright surface and of allowing the comminuted materials to slide or slough downward due to the effect of gravity.

Figure 6:
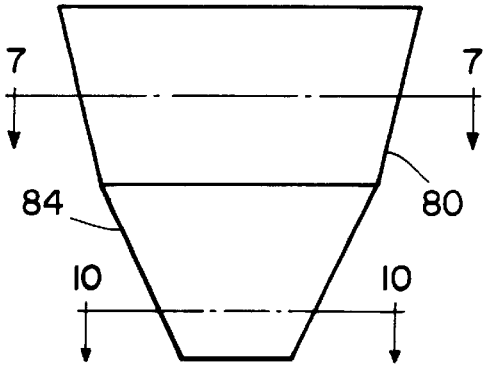
FIG. 6 is a side view of an alternate blending container.
Figure 7:
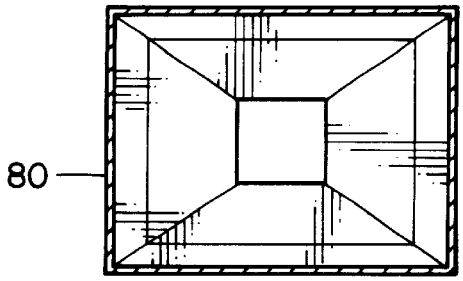
FIG. 7 is a cross-section of the alternate blending container of FIG. 6.
Figure 8:
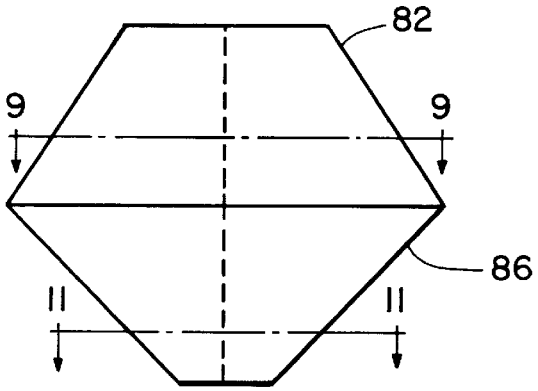
FIG. 8 is a side view of another alternate blending container.
Figure 9:
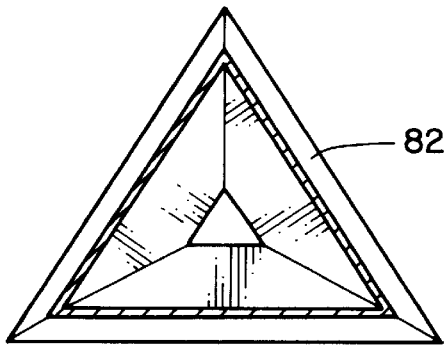
FIG. 9 is a cross-section of the alternate blending container of FIG. 8.

In the embodiments above, the side slough wall 14 is described as substantially vertical and as being cylindrical, however, the side slough wall 14 may also conceivably take other shapes. For example, as shown in FIGS. 6 and 7, a side slough wall 80 slopes outward and has a rectangular cross-section. Further, as shown in FIGS. 8 and 9, a side slough wall 82 slopes inward and has a triangular cross-section.

Figure 10:
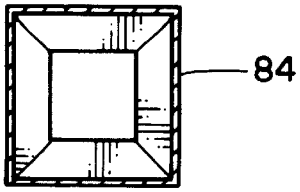
FIG. 10 is another cross-section of the alternate blending container of FIG. 6.
Figure 11:
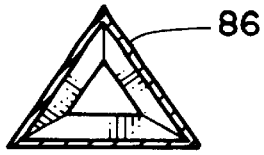
FIG. 11 is another cross-section of the alternate blending container of FIG. 8.

Similarly, the slide wall 16 in the first embodiment is described as conical, however, the slide wall 16 may take other shapes. For example, as shown in FIGS. 6 and 10, a slide wall 84 has a rectangular cross-section or, as shown in FIGS. 8 and 11, a slide wall 86 has a triangular cross-section.

Figure 12:
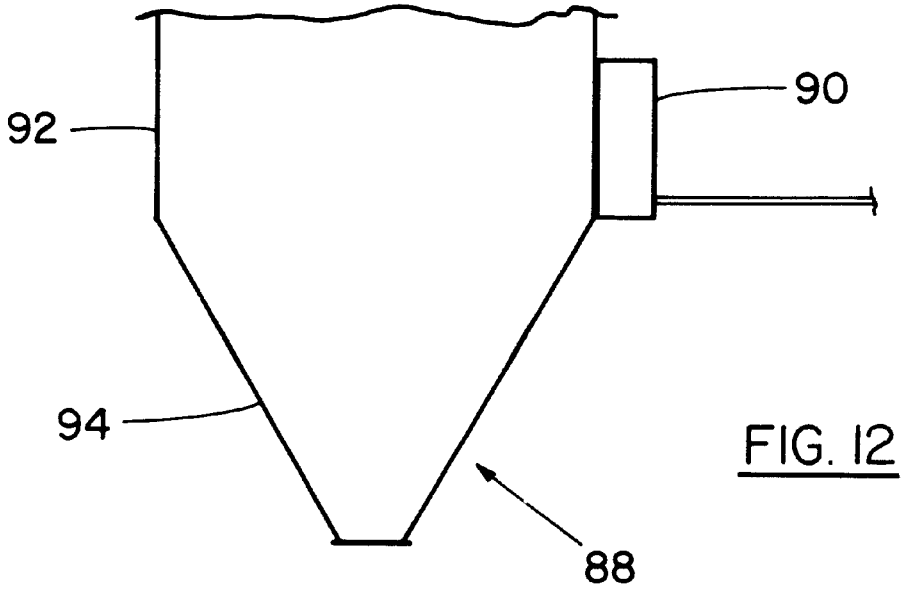
FIG. 12 is a schematic view of a blending container provided with a vibration mechanism.

In another embodiment of the invention, as shown in FIG. 12, a blending container 88 is provided with a vibration mechanism 90 that vibrates the blending container 88 in order to add to the effects of gravity and further induce the materials to release from a side slough wall 92 and slough downward. The vibration mechanism 90 can also be controlled by the CPU 78. Alternatively, although not shown, the vibration mechanism 90 could be adapted to operate on only the side slough wall 92 or on only a slide wall 94.

Figure 13:
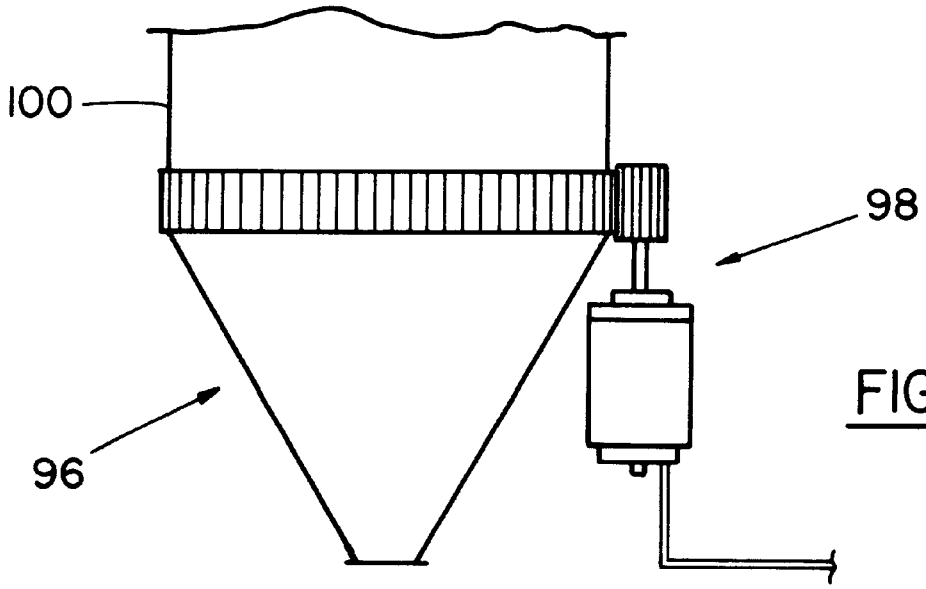
FIG. 13 is a schematic view of a blending container provided with a rotation mechanism.

In yet another embodiment of the invention, as shown in FIG. 13, a blending container 96 is provided with a rotation mechanism 98 that rotates the blending container 96 in a direction opposite to the rotation of the distribution shaft 58. The rotation mechanism 98 allows adjustment of the distribution of materials within the blending container 96 and adds to the effects of gravity to further induce the materials to release from a side slough wall 100 and slough downward. The rotation mechanism 98 can also be controlled by the CPU 78.

Figure 14:
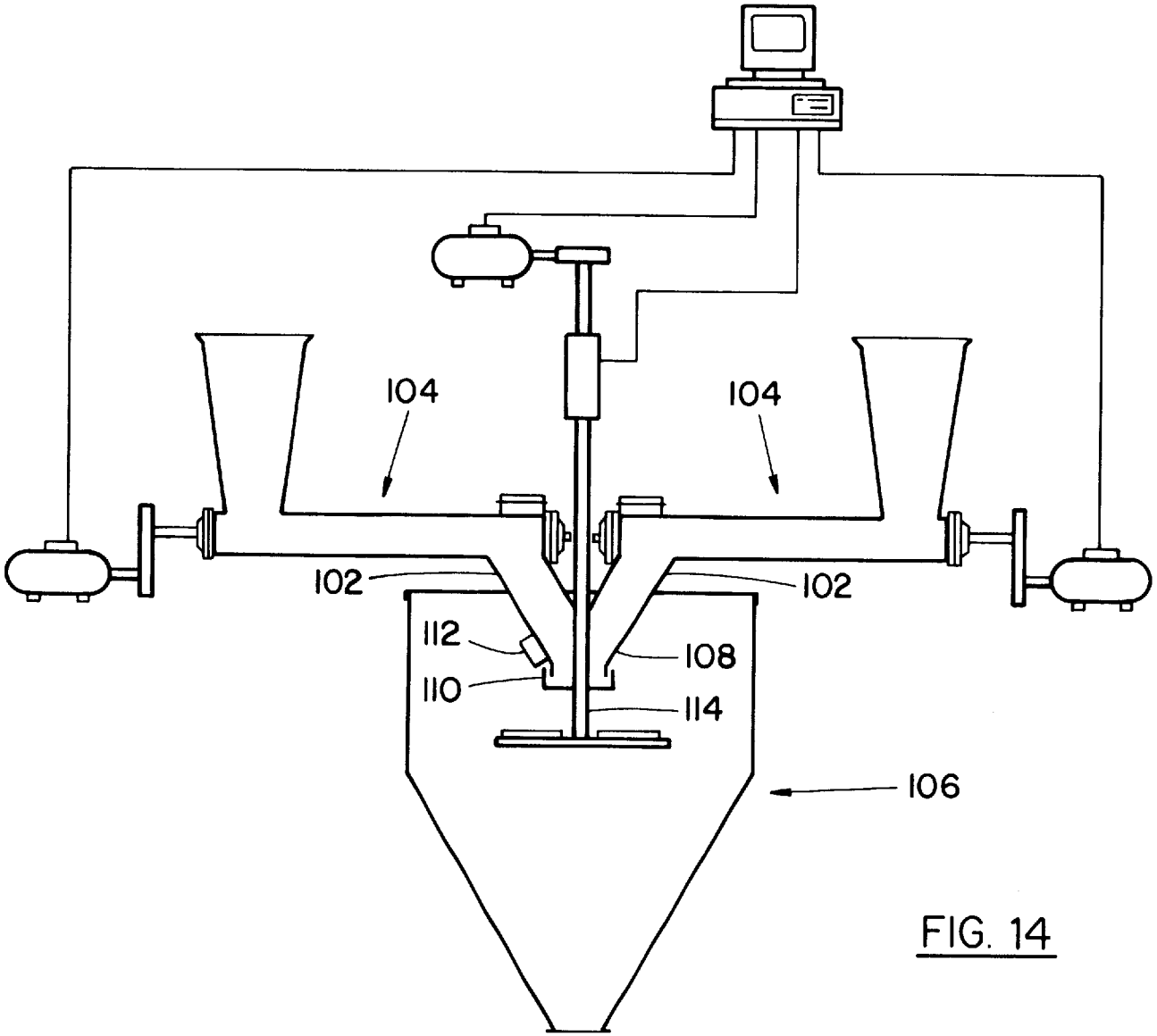
FIG. 14 is a schematic view of another embodiment of the dry blending apparatus illustrating the invention.

In yet another embodiment of the invention, as shown in FIG. 14, delivery chutes 102 of feed units 104 meet in the center of a blending container 106 to form an integrated delivery chute 108. Similar to the first embodiment, the integrated delivery chute 108 is provided with an adjustable skirt 110 and skirt adjustment mechanism 112. A distribution shaft 114 runs through the center of the integrated delivery chute 108 in order to allow the dry materials to be fed as close to the center of the blending container 106 as possible.

The foregoing is a description of preferred embodiments of the invention which are given here by way of example only. The invention is not to be taken as limited to any of the specific features as described, but comprehends all such variations thereof as come within the scope of the appended claims.

What is claimed is:

1. A dry blending apparatus for blending dry comminuted materials comprising:

a substantially upright wall defining a blending enclosure;

feed means for feeding said dry comminuted materials into the interior of said blending enclosure out of contact with said wall;

a rotational distribution mechanism for receiving said dry comminuted materials and dispersing said dry comminuted materials outwardly onto said upright wall by causing said dry comminuted materials to fly outwardly by centrifugal force; and, distribution adjustment mechanism for moving said distribution mechanism upwardly or downwardly within said blending enclosure.

2. A dry blending apparatus as claimed in claim 1, wherein said blending enclosure is substantially cylindrical.

3. A dry blending apparatus as claimed in claim 1, wherein said blending enclosure has a non-circular cross-section.

4. A dry blending apparatus as claimed in claim 1, further comprising a tapering chute connected at a base of said substantially upright wall.

5. A dry blending apparatus as claimed in claim 4, wherein said tapering chute is substantially conical.

6. A dry blending apparatus as claimed in claim 4, further comprising:

a vibration mechanism for vibrating said tapering chute.

7. A dry blending apparatus as claimed in claim 4, further comprising:

a vibration mechanism for vibrating said wall and said tapering chute.

8. A dry blending apparatus as claimed in claim 1, said rotational distribution mechanism comprising:

a distribution motor;

a distribution shaft driven by said distribution motor placed along a central axis of said blending enclosure; and a distribution plate connected to said shaft out of contact with said wall;

wherein said distribution plate and said feed mechanism are positioned such that said dry comminuted materials are fed from said feed mechanism onto said distribution plate.

9. A dry blending apparatus as claimed in claim 8, wherein said distribution plate is provided with a plurality of acceleration ridges.

10. A dry blending apparatus as claimed in claim 9, wherein said acceleration ridges are provided on a top surface of said distribution plate.

11. A dry blending apparatus as claimed in claim 1, said feed means comprising a plurality of feed mechanisms.

12. A dry blending apparatus as claimed in claim 11, said feed mechanism comprising:

a hopper;

an auger tube connected to said hopper;

an auger shaft disposed within said auger tube;

an auger screw provided at one end of said auger shaft;

a plurality of paddles provided at a second end of said auger shaft;

an auger drive motor for driving said auger shaft; and a delivery chute connected to said auger tube adjacent to said plurality of paddles and oriented to deliver the dry comminuted materials into said blending enclosure away from said wall.

13. A dry blending apparatus as claimed in claim 1, further comprising:

a vibration mechanism for vibrating said wall.

14. A dry blending apparatus for blending dry comminuted materials comprising:

an upright cylindrical wall defining a blending enclosure;

a plurality of feed mechanisms for feeding dry comminuted materials into said blending enclosure out of contact with said wall;

a distribution shaft positioned on a centre-line of said blending enclosure;

a distribution motor for rotating said distribution shaft;

a distribution plate attached to said distribution shaft to receive said dry comminuted materials and positioned such that said dry comminuted materials from said feed mechanism contact said distribution plate whereby said dry comminuted materials are distributed against said wall by centrifugal force;

a tapering chute in communication with said blending enclosure for collecting said dry comminuted materials as said dry comminuted materials slough off said wall due to the force of gravity; and, distribution adjustment mechanism for moving said distribution plate upwardly or downwardly within said blending enclosure.

15. A dry blending apparatus as claimed in claim 14, further comprising:

a rotation mechanism for rotating said wall in a direction opposite to the direction of rotation of said rotational distribution mechanism.

16. A dry blending apparatus for blending dry comminuted materials comprising:

a substantially upright wall defining a blending enclosure;

feed means for feeding said dry comminuted materials into the interior of said blending enclosure out of contact with said wall;

a rotational distribution mechanism for receiving said dry comminuted materials and dispersing said dry comminuted materials outwardly onto said upright wall by causing said dry comminuted materials to fly outwardly by centrifugal force; and, a rotation mechanism for rotating said substantially upright wall in a direction opposite to the direction of rotation of said rotational distribution mechanism.

17. A dry blending apparatus as claimed in claim 16, further comprising a distribution adjustment mechanism for moving said distribution plate upwardly or downwardly within said blending enclosure.

* * * * *